US009553367B2

(12) United States Patent
Chi et al.

(10) Patent No.: US 9,553,367 B2
(45) Date of Patent: Jan. 24, 2017

(54) ANTENNA STRUCTURE AND WIRELESS COMMUNICATION DEVICE EMPOLYING SAME

(71) Applicant: FIH (Hong Kong) Limited, Kowloon (HK)

(72) Inventors: Chuan-Chou Chi, New Taipei (TW); Chi-Sheng Liu, New Taipei (TW); Chih-Yang Tsai, New Taipei (TW); Hao-Ying Chang, New Taipei (TW); Chao-Wei Ho, New Taipei (TW); Pai-Cheng Huang, New Taipei (TW)

(73) Assignee: FIH (HONG KONG) LIMITED, Kowloon (HK)

( * ) Notice: Subject to any disclaimer, the term of this patent is extended or adjusted under 35 U.S.C. 154(b) by 265 days.

(21) Appl. No.: 14/315,008

(22) Filed: Jun. 25, 2014

(65) Prior Publication Data

US 2015/0002366 A1 Jan. 1, 2015

(30) Foreign Application Priority Data

Jun. 28, 2013 (TW) ..... 102123216 A

(51) Int. Cl.

| | |
|---|---|
| ***H01Q 19/00*** | (2006.01) |
| ***H01Q 21/00*** | (2006.01) |
| ***H01Q 5/371*** | (2015.01) |
| ***H01Q 1/24*** | (2006.01) |
| ***H01Q 9/42*** | (2006.01) |
| ***H01Q 21/28*** | (2006.01) |

(52) U.S. Cl.
CPC ..... *H01Q 5/371* (2015.01); *H01Q 1/243* (2013.01); *H01Q 9/42* (2013.01); *H01Q 21/28* (2013.01)

(58) Field of Classification Search
CPC ..... H01Q 21/28; H01Q 5/371; H01Q 5/357; H01Q 1/243; H01Q 1/521; H01Q 1/523; H01Q 1/525; H01Q 1/36; H01Q 9/42
See application file for complete search history.

(56) References Cited

U.S. PATENT DOCUMENTS

2014/0368398 A1* 12/2014 Ying ..... H01Q 1/48 343/841

FOREIGN PATENT DOCUMENTS

CN 102751591 A 10/2012
KR 10-2010-0016177 * 10/2010 ..... H01Q 13/08

* cited by examiner

*Primary Examiner* — Dameon E Levi
*Assistant Examiner* — Ricardo Magallanes
(74) *Attorney, Agent, or Firm* — Zhigang Ma

(57) ABSTRACT

An antenna structure includes a main antenna, a diversity antenna, and at least one accessorial antenna. The main antenna extends in a main antenna direction. The diversity antenna is spaced apart from the main antenna and extends in a first radiation direction substantially parallel to the main antenna direction. The at least one accessorial antenna extends in a second radiation direction which is substantially perpendicular to either the main antenna direction or the first radiation direction.

20 Claims, 2 Drawing Sheets

ANTENNA STRUCTURE AND WIRELESS COMMUNICATION DEVICE EMPOLYING SAME

CROSS-REFERENCE TO RELATED APPLICATION

The present application claims the benefit of under 35 U.S.C. 119 from Taiwan Application No. 102123216, filed on Jun. 28, 2013.

FIELD

This disclosure generally relates to antennas, and particularly to an antenna structure using multi-input multi-output (MIMO) technique and a wireless communication device employing same.

BACKGROUND

A MIMO antenna technology uses two or more antennas (usually including a main antenna and a diversity antenna) at each base station and mobile communication terminal carrying data and receiving and detecting signals. Radiation efficiency, isolation, and envelope correlation coefficient (ECC) are important parameters for measurement of a performance of the MIMO antenna.

Usually, an ECC of the MIMO antenna system is required to be less than 0.5, and the ECC between the main antenna and the diversity antenna is lower, a data inaccuracy probability decoded by a receiving terminal of the MIMO antenna is also lower.

BRIEF DESCRIPTION OF THE DRAWINGS

Many aspects of the embodiments can be better understood with reference to the drawings. The components in the drawings are not necessarily drawn to scale, the emphasis instead being placed upon clearly illustrating the principles of the disclosure.

DETAILED DESCRIPTION

Figure 1:
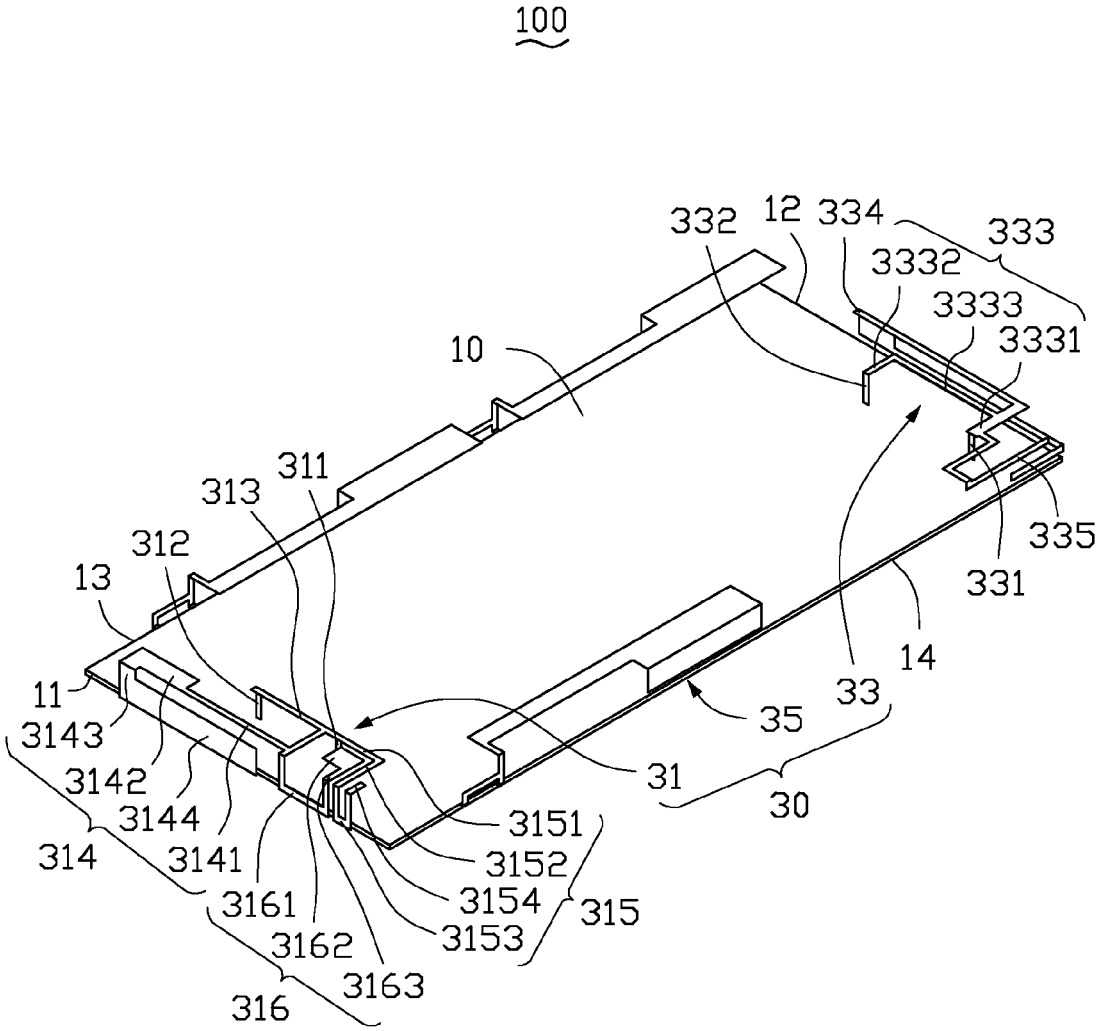
FIG. 1 is an isometric view of an exemplary embodiment of a wireless communication device employing an antenna structure.
Figure 2:
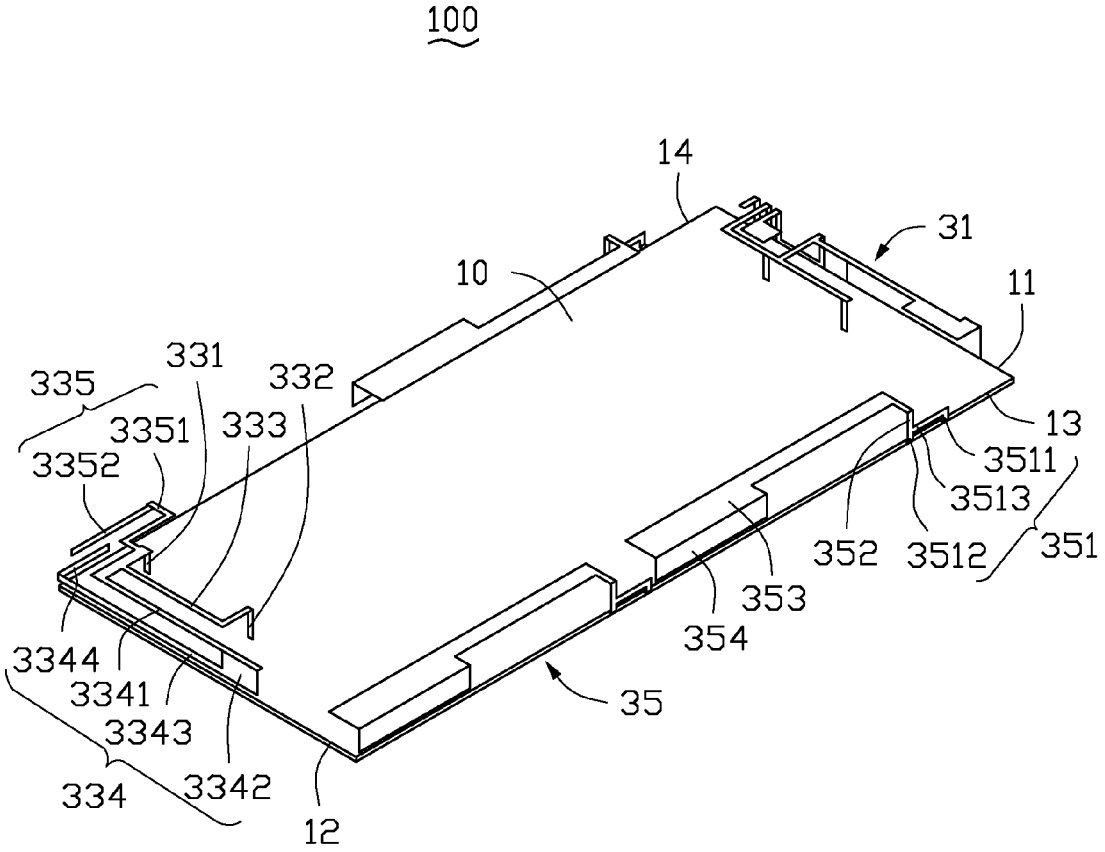
FIG. 2 is similar to FIG. 1, but showing the wireless communication device in another angle.

FIGS. 1 and 2 illustrate an embodiment of a wireless communication device 100 including a printed circuit board (PCB) 10 and an antenna structure 30 mounted on the PCB 10. The antenna structure 30 includes a main antenna 31, a diversity antenna 33, and a plurality of accessorial antennas 35.

The PCB 10 includes a first side 11, a second side 12, a third side 13, and a fourth side 14. The first side 11 is substantially parallel to the second side 12. The third side 13 is substantially parallel to the fourth side 14. The third side 13 and the fourth side 14 are substantially perpendicular to either the first side 11 or the second side 12. In the embodiment, the PCB 10 is a substantially rectangular board, the first and second sides 11 and 12 are a pair of short sides of the PCB 10, the third and fourth sides 13 and 14 are a pair of long sides of the PCB 10.

The main antenna 31 is positioned at the first side 11 of the PCB 10. In the embodiment, the main antenna 31 includes a feeding arm 311, a grounding arm 312, a connecting arm 313, a first branch 314, a second branch 315, and a third branch 316. The feeding arm 311 is electronically connected to, and positioned substantially perpendicular to, the PCB 10 for feeding current signal. The grounding arm 312 is electronically connected to, and positioned substantially perpendicular to, the PCB 10 to be grounded through the PCB 10. The grounding arm 312 is substantially parallel to, and spaced apart from, the feeding arm 311. A connection between an end of the feeding arm 311 and an end of the grounding arm 312 is substantially parallel to the first side 11 of the PCB 10.

The connecting arm 313 is positioned in a plane substantially parallel to a plane in which the PCB 10 is positioned. One end of the connecting arm 313 is connected to an end of the feeding arm 311 away from the PCB 10. Another end of the connecting arm 313 is connected to an end of the grounding arm 312 away from the PCB 10.

All of the first, second, and third branches 314, 315, and 316 extend from the connecting arm 313. In the embodiment, all of the first, second, and third branches 314, 315, and 316 are metallic meander strips. The first branch 314 includes a first radiating arm 3141, a first metal sheet 3142, a second metal sheet 3143, and a third metal sheet 3144 connected in that order. The first radiating arm 3141 and the first metal sheet 3142 are coplanar with the connecting arm 313. The first radiating arm 3141 is a substantially L-shaped strip. The first radiating arm 3141 substantially perpendicularly extends from a side of the connecting arm 313, and then extends away from the feeding arm 311 to be parallel with the connecting arm 313. The first metal sheet 3142 is a substantially L-shaped sheet. A width of the first metal sheet 3142 is greater than a width of the first radiating arm 3141. The first metal sheet 3142 continuously extends from an end of the first radiating arm 3141 parallel with the connecting arm 313, and then substantially perpendicularly extends away the connecting arm 313. The second metal sheet 3143 is positioned in a plane substantially parallel to a plane in which the feeding arm 311 and the grounding arm 312 are positioned. The second metal sheet 3143 is substantially perpendicularly connected to an end of the first metal sheet 3142 away from the connecting arm 313. The third metal sheet 3144 is coplanar with the second metal sheet 3143. A length of the third metal sheet 3144 is greater than a length of the second metal sheet 3143. The third metal sheet 3144 is substantially perpendicularly connected to an end of the second metal sheet 3143 away from the first metal sheet 3132, and forms a L-shaped sheet with the second metal sheet 3143.

The second branch 315 includes a second radiating arm 3151, a third radiating arm 3152, a fourth radiating arm 3153, and a fifth radiating arm 3154 connected in that order and with a same width. The second radiating arm 3151, the third radiating arm 3152, and the fifth radiating arm 3154 are coplanar with the connecting arm 313. The second radiating arm 3151 continuously extends from the connecting arm 313. In other words, the second radiating arm 3151 is collinear with the connecting arm 313. The third radiating arm 3152 is a substantially rectangular strip. The third radiating arm 3152 is substantially perpendicularly connected to an end of the second radiating arm 3151 away from the connecting arm 313.

The fourth radiating arm 3153 is a substantially U-shaped strip and is coplanar with the second metal sheet 3143 and the third metal sheet 3144. The fourth radiating arm 3153 substantially perpendicularly extends from an end of the third radiating arm 3152 away from the second radiating arm 3151 parallel to the second metal sheet 3143. Then extends away the second metal sheet 3143 to be parallel to the third metal sheet 3144, and extends towards the third radiating arm 3152 to be parallel to the second metal sheet 3143. The fifth radiating arm 3154 is a substantially rectangular strip. The fifth radiating arm 3154 substantially perpendicularly extends from an end of the fourth radiating arm 3153 to be parallel to the third radiating arm 3152. A length of the fifth radiating arm 3154 is less than a length of the third radiating arm 3152.

The third branch 316 includes a sixth radiating arm 3161, a seventh radiating arm 3162, and a fourth metal sheet 3163. The sixth radiating arm 3161 is coplanar with the second metal sheet 3143 and the third metal sheet 3144, and is positioned between the third metal sheet 3144 and the fourth radiating arm 3153. The sixth radiating arm 3161 is a substantially U-shaped strip, and two ends of the sixth radiating arm 3161 are perpendicularly connected to a junction of the first radiating arm 3141 and the seventh radiating arm 3162, respectively. The seventh radiating arm 3162 is a substantially rectangular strip and is coplanar with the connecting arm 313. The seventh radiating arm 3162 substantially perpendicularly extends towards the connecting arm 313 to be parallel to the third radiating arm 3152. The fourth metal sheet 3163 is a substantially rectangular sheet and is coplanar with the connecting arm 313. The fourth metal sheet 3163 substantially perpendicularly extends from an edge of the seventh radiating arm 3162 adjacent to the first radiating arm 3141 parallel with the connecting arm 313. A width of the fourth metal sheet 3163 is greater than a width of the seventh radiating arm 3162.

The diversity antenna 33 is positioned at the second side 12 of the PCB 10. The diversity antenna 33 includes a feeding portion 331, a grounding portion 332, a connecting portion 333, a first radiating portion 334, and a second radiating portion 335.

The feeding portion 331 is electronically connected to and positioned substantially perpendicular to the PCB 10 to feed current signal for the diversity antenna 33. The grounding portion 332 is electronically connected to, and positioned substantially perpendicular to, the PCB 10 to be grounded through the PCB 10. The grounding portion 332 is parallel to, and spaced apart from, the feeding portion 331. A connection between the grounding portion 332 and the feeding portion 331 is parallel to the second side 12 of the PCB 10.

The connecting portion 333 is positioned in a plane substantially parallel with the plane in which the PCB 10 is positioned. The connecting portion 333 is substantially U-shaped strip and includes a first connecting section 3331, a second connecting section 3332, and a third connecting section 3333. The first connecting section 3331 is substantially perpendicularly connected to an end of the feeding portion 331 away from the PCB 10. The second connecting section 3332 is substantially perpendicularly connected to an end of the grounding portion 332 away from the PCB 10. A length of the second connecting section 3332 is substantially equal to a length of the first connecting section 3331. An end of the third connecting section 3333 is substantially perpendicularly connected to an end of the first connecting section 3331 away from the feeding portion 331. Another end of the third connecting section 3333 is substantially perpendicularly connected to an end of the second connecting section 3332 away from the grounding portion 332.

Both the first radiating portion 334 and the second radiating portion 335 extend from the connecting portion 333, and are metallic meander strips. In detail, the first radiating portion 334 includes a first radiating section 3341, a second radiating section 3342, a third radiating section 3343, and a fourth radiating section 3344.

The first radiating section 3341 is a substantially L-shaped strip, and is coplanar with the connecting portion 333. The first radiating section 3341 continuously extends from the first connecting section 3331, and then extends towards the second connecting section 3332 to be parallel to the third connecting section 3333. The second radiating section 3342 is positioned in a plane substantially parallel to the plane in which the feeding portion 331 and the grounding portion 332 are positioned. The second radiating section 3342 is substantially perpendicularly connected to an end of the first radiating section 3341 away from the first connecting section 3331. A length of the third radiating section 3343 is greater than a length of the second radiating section 3342, and a width of the third radiating section 3343 is less than a width of the second radiating section 3342. The third radiating section 3343 is substantially perpendicularly connected to an end of the second radiating section 3342 away from the first radiating section 3341 to form an L-shaped strip with the second radiating section 3342. The fourth radiating section 3344 is a substantially rectangular strip and is positioned in a plane substantially perpendicular to a plane in which the connecting portion 333 is positioned. The fourth radiating section 3344 is substantially perpendicularly connected to an end of the third radiating section 3343 away from the second radiating section 3342.

The second radiating portion 335 includes a fifth radiating section 3351 and a sixth radiating section 3352. In the embodiment, the fifth radiating section 3351 and the sixth radiating section 3352 have a same width, and are meander strips. The fifth radiating section 3351 is coplanar with the connecting portion 333. The fifth radiating section 3351 extends from a junction between the feeding portion 331 and the first connecting section 3331 parallel to the third connecting section 3333. Then extends away the first radiating section 3341 parallel to the first connecting section 3331, and extends away from the second connecting section 3332 to be parallel to the third connecting section 3333. The sixth radiating section 3352 is coplanar with the fourth radiating section 3344. The sixth radiating section 3352 is substantially perpendicularly connected to an end of the fifth radiating section 3351 away from first connecting section 3331 and is parallel to the fourth radiating section 3344.

In the embodiment, there is at least one accessorial antenna 35, which can be positioned in either the third side 13 of the PCB 10 or the fourth side 14 of the PCB 10. For example, there are three accessorial antennas 35. One accessorial antenna 35 is positioned in the fourth side 14 of the PCB 10, and two accessorial antennas 35 are positioned in the third side 13 of the PCB 10.

The accessorial antenna 35 includes a grounding terminal 351, a first accessorial arm 352, a second accessorial arm 353, and a third accessorial arm 354. The grounding terminal 351 is a substantially U-shaped strip and includes a first grounding section 3511, a second grounding section 3512, and a coupling section 3513. The first and second grounding sections 3511 and 3512 are substantially perpendicular to the PCB 10. The first grounding section 3511 is parallel to and spaced apart from the second grounding section 3512. A connection between the first grounding section 3511 and the second grounding section 3512 is parallel to the third side 13 of the PCB 10. Both the first grounding section 3511 and the second grounding section 3512 are electronically connected to the PCB 10, to be grounded through the PCB 10. One end of the coupling section 3513 is substantially perpendicularly connected to an end of the first grounding section 3511.

Another end of the coupling section 3513 is substantially perpendicularly connected to an end of the second grounding section 3512.

The first accessorial arm 352 is coplanar with the grounding terminal 351. The first accessorial arm 352 continuously extends from the second grounding section 3512. The second accessorial arm 353 is a substantially U-shaped sheet and is coplanar with the connecting arm 313 and the connecting portion 333. The second accessorial arm 353 extends from an end of the first accessorial arm 352 away from the second grounding section 3512 parallel to the connecting arm 313. Then extends towards the diversity antenna 33 parallel to the first connecting section 3331, and extends towards the first accessorial arm 352 parallel to the connecting arm 313. The third accessorial arm 354 is coplanar with the grounding terminal 351. The third accessorial arm 354 substantially perpendicularly extends from an end of the second accessorial arm 353 away from the first accessorial arm 352.

Table 1 shows ECC values of the antenna structure 30 at a sample operating frequency band of about 791-890 MHz (LTE). As shown in Table 1, the ECC values of the antenna structure 30 are all less than 0.5 at each sample frequency, thus the antenna structure 30 can achieve an approving transmission performance.

TABLE 1

| Frequency (MHz) | 796 | 806 | 816 | 874 | 881.5 | 889 |
|---|---|---|---|---|---|---|
| ECC | 0.435 | 0.352 | 0.288 | 0.217 | 0.246 | 0.288 |

In summary, the main antenna 31 is positioned along the first side 11 of the PCB 10 and extends in a main antenna direction (e.g., extends along the first side 11 of the PCB 10). The diversity antenna 33 is positioned along the second side 12 of the PCB 10 and extends in a first radiation direction. The plurality of accessorial antennas 35 are positioned along the third and fourth sides 13 and 14 of the PCB 10 and extend in a second radiation direction. The first radiation direction of the diversity antenna 33 is substantially parallel to the main antenna direction of the main antenna 31, and the second radiation direction of the plurality of accessorial antennas 35 is substantially perpendicular to either the main antenna direction of the main antenna 31 or the first radiation direction of the diversity antenna 33. Thus, a radiation direction of the accessorial antennas 35 is also different from a radiating direction of the main antenna 31 and the diversity antenna 33, thereby a low ECC can be achieved. In addition, all of the accessorial antennas 35 do not need an added signal source, and are grounded through the grounding terminal 351. Thus, a grounding area of the main antenna 31 and the diversity antenna 33 can be effectively increased, and a low ECC can be achieved.

The embodiments and their advantages will be understood from the foregoing description. It will be apparent that various changes may be made thereto without departing from the scope of the disclosure or sacrificing all of its material advantages. The examples herein are not illustrative, and are not intended to limit the scope of the following claims.

What is claimed is:

1. An antenna structure comprising:

a main antenna extending in a main antenna direction;

a diversity antenna spaced apart from the main antenna and extending in a first radiation direction substantially parallel to the main antenna direction; and at least one accessorial antenna extending in a second radiation direction; wherein the second radiation direction is substantially perpendicular to either the main antenna direction or the first radiation direction;

wherein the at least one accessorial antenna comprises a grounding terminal, a first accessorial arm, a second accessorial arm, and a third accessorial arm, the first accessorial arm and the third accessorial arm are coplanar with the grounding terminal, the second accessorial arm is positioned in a plane substantially perpendicular to a plane in which the grounding terminal is positioned; the grounding terminal comprises a first grounding section, a second grounding section, and a coupling section, one end of the coupling section is substantially perpendicularly connected to an end of the first grounding section, another end of the coupling section is substantially perpendicularly connected to an end of the second grounding section; the first accessorial arm continuously extends from the second grounding section, the second accessorial arm extends from an end of the first accessorial arm away from the second grounding section, then extends towards the diversity antenna, and extends towards the first accessorial arm, the third accessorial arm substantially perpendicularly extends from an end of the second accessorial arm away from the first accessorial arm.

2. The antenna structure of claim 1, wherein the main antenna comprises a feeding arm, a grounding arm, a connecting arm, a first branch, a second branch, and a third branch; the diversity antenna comprises a feeding portion and a grounding portion; a connection between the feeding arm and the grounding arm is parallel to a connection between the feeding portion and the grounding portion; an end of the connecting arm is connected to an end of the feeding arm, another end of the connecting arm is connected to an end of the grounding arm, and all of the first, second, and third branches extend from the connecting arm.

3. The antenna structure of claim 2, wherein the first branch comprises a first radiating arm, a first metal sheet, a second metal sheet, and a third metal sheet connected in that order; the first radiating arm and the first metal sheet are coplanar with the connecting arm; the first radiating arm substantially perpendicularly extends from a side of the connecting arm, and then extends away from the feeding arm to be parallel to the connecting arm; the first metal sheet continuously extends from an end of the first radiating arm parallel to the connecting arm, and then substantially perpendicularly extends away the connecting arm; the second metal sheet is positioned in a plane substantially parallel to a plane in which the feeding arm and the grounding arm are positioned; the second metal sheet is substantially perpendicularly connected to an end of the first metal sheet away from the connecting arm; and the third metal sheet is coplanar with the second metal sheet and is substantially perpendicularly connected to an end of the second metal sheet away from the first metal sheet.

4. The antenna structure of claim 3, wherein the second branch comprises a second radiating arm, a third radiating arm, a fourth radiating arm, and a fifth radiating arm connected in that order; the second radiating arm, the third radiating arm, and the fifth radiating arm are coplanar with the connecting arm; the second radiating arm continuously extends from the connecting arm; the third radiating arm is substantially perpendicularly connected to an end of the second radiating arm away from an end of the second radiating arm away from the connecting arm; the fourth radiating arm is coplanar with the second metal sheet and the third metal sheet; the fourth radiating arm substantially perpendicularly extends from an end of the third radiating arm away from the second radiating arm to be parallel with the second metal sheet, then extends away the second metal sheet to be parallel to the third metal sheet, and extends towards the third radiating arm to be parallel with the second metal sheet; and the fifth radiating arm substantially perpendicularly extends from an end of the fourth radiating arm to be parallel with the third radiating arm.

5. The antenna structure of claim 4, wherein the third branch comprises a sixth radiating arm, a seventh radiating arm, and a fourth metal sheet; the sixth radiating arm is coplanar with the second metal sheet and the third metal sheet, and is positioned between the third metal sheet and the fourth radiating arm; two ends of the sixth radiating arm are perpendicularly connected to a junction of the first radiating arm and the seventh radiating arm, respectively; the seventh radiating arm is coplanar with the connecting arm; the seventh radiating arm substantially perpendicularly extends towards the connecting arm to be parallel to the third radiating arm; the fourth metal sheet is coplanar with the connecting arm; and the fourth metal sheet substantially perpendicularly extends from an edge of the seventh radiating arm adjacent to the first radiating arm to be parallel with the connecting arm.

6. The antenna structure of claim 2, wherein the diversity antenna further comprises a connecting portion, a first radiating portion, and a second radiating portion; wherein the first radiating portion and the second radiating portion extend from the connecting portion; the connecting portion is positioned in a plane substantially perpendicular to the plane in which the feeding portion and the grounding portion are positioned; the connecting portion comprises a first connecting section, a second connecting section, and a third connecting section; the first connecting section is substantially perpendicularly connected to an end of the feeding portion; the second connecting section is substantially perpendicularly connected to an end of the grounding portion; an end of the third connecting section is substantially perpendicularly connected to an end of the first connecting section away from the feeding portion, and another end of the third connecting section is substantially perpendicularly connected to an end of the second connecting section away from the grounding portion.

7. The antenna structure of claim 6, wherein the first radiating portion comprises a first radiating section, a second radiating section, a third radiating section, and a fourth radiating section; the first radiating section is coplanar with the connecting portion; the first radiating section continuously extends from first connecting section, then extends towards the second connecting section to be parallel to the third connecting section; the second radiating section is positioned in a plane substantially parallel to the plane in which the feeding portion and the grounding portion are positioned; the second radiating section is substantially perpendicularly connected to an end of the first radiating section away from the first connecting section; the third radiating section is substantially perpendicularly connected to an end of the second radiating section away from the first radiating section; the fourth radiating section is positioned in a plane substantially perpendicular to a plane in which the connecting portion is positioned; and the fourth radiating section is substantially perpendicularly connected to an end of the third radiating section away from the second radiating section.

8. The antenna structure of claim 7, wherein the second radiating portion comprises a fifth radiating section and a sixth radiating section; the fifth radiating section is coplanar with the connecting portion; the fifth radiating section extends from a junction between the feeding portion and the first connecting section to be parallel to the third connecting section, then extends away the first radiating section to be parallel to the first connecting section, and extends away the second connecting section to be parallel to the third connecting section; the sixth radiating section is coplanar with the fourth radiating section; and the sixth radiating section is substantially perpendicularly connected to an end of the fifth radiating section away from first connecting section and is parallel to the fourth radiating section.

9. The antenna structure of claim 2, wherein a connection between the first grounding section and the second grounding section is substantially perpendicular to the connection between the feeding portion and the grounding portion.

10. The antenna structure of claim 9, wherein the second accessorial arm extends from an end of the first accessorial arm away from the second grounding section to be parallel to the connecting arm, then extends towards the diversity antenna to be parallel to the first connecting section, and extends towards the first accessorial arm to be parallel to the connecting arm.

11. A wireless communication device, comprising:

a printed circuit board (PCB) comprising a first side, a second side parallel to the first side, a third side perpendicularly connected between the first side and the second side, and a fourth side parallel to the third side; and an antenna structure mounted on the PCB, the antenna structure comprising:

a main antenna positioned along the first side and extending in a main antenna direction;

a diversity antenna positioned along the second side and extending in a first radiation direction substantially parallel to the main antenna direction; and at least one accessorial antenna positioned along either the third side or the fourth side and extending in a second radiation direction; wherein the second radiation direction is substantially perpendicular to either the main antenna direction or the first radiation direction;

wherein the at least one accessorial antenna comprises a grounding terminal, a first accessorial arm, a second accessorial arm, and a third accessorial arm, the first accessorial arm and the third accessorial arm are coplanar with the grounding terminal, the second accessorial arm is positioned in a plane substantially perpendicular to a plane in which the grounding terminal is positioned; the grounding terminal comprises a first grounding section, a second grounding section, and a coupling section, one end of the coupling section is substantially perpendicularly connected to an end of the first grounding section, another end of the coupling section is substantially perpendicularly connected to an end of the second grounding section; the first accessorial arm continuously extends from the second grounding section, the second accessorial arm extends from an end of the first accessorial arm away from the second grounding section, then extends towards the diversity antenna, and extends towards the first accessorial arm, the third accessorial arm substantially perpendicularly extends from an end of the second accessorial arm away from the first accessorial arm.

12. The wireless communication device of claim 11, wherein the main antenna comprises a feeding arm, a grounding arm, a connecting arm, a first branch, a second branch, and a third branch, the diversity antenna comprises a feeding portion and a grounding portion, wherein a connection between the feeding arm and the grounding arm is parallel to a connection between the feeding portion and the grounding portion; and an end of the connecting arm is connected to an end of the feeding arm, another end of the connecting arm is connected to an end of the grounding arm, all of the first, second, and third branches extend from the connecting arm.

13. The wireless communication device of claim 12, wherein the first branch comprises a first radiating arm, a first metal sheet, a second metal sheet, and a third metal sheet connected in that order; the first radiating arm and the first metal sheet are coplanar with the connecting arm; the first radiating arm substantially perpendicularly extends from a side of the connecting arm, and then extends away from the feeding arm to be parallel to the connecting arm; the first metal sheet continuously extends from an end of the first radiating arm parallel to the connecting arm, and then substantially perpendicularly extends away the connecting arm; the second metal sheet is positioned in a plane substantially parallel to a plane in which the feeding arm and the grounding arm are positioned; the second metal sheet is substantially perpendicularly connected to an end of the first metal sheet away from the connecting arm; and the third metal sheet is coplanar with the second metal sheet and is substantially perpendicularly connected to an end of the second metal sheet away from the first metal sheet.

14. The wireless communication device of claim 13, wherein the second branch comprises a second radiating arm, a third radiating arm, a fourth radiating arm, and a fifth radiating arm connected in that order; the second radiating arm, the third radiating arm, and the fifth radiating arm are coplanar with the connecting arm; the second radiating arm continuously extends from the connecting arm; the third radiating arm is substantially perpendicularly connected to an end of the second radiating arm away from an end of the second radiating arm away from the connecting arm; the fourth radiating arm is coplanar with the second metal sheet and the third metal sheet; the fourth radiating arm substantially perpendicularly extends from an end of the third radiating arm away from the second radiating arm to be parallel with the second metal sheet, then extends away the second metal sheet to be parallel to the third metal sheet, and extends towards the third radiating arm to be parallel with the second metal sheet; and the fifth radiating arm substantially perpendicularly extends from an end of the fourth radiating arm to be parallel with the third radiating arm.

15. The wireless communication device of claim 14, wherein the third branch comprises a sixth radiating arm, a seventh radiating arm, and a fourth metal sheet; the sixth radiating arm is coplanar with the second metal sheet and the third metal sheet, and is positioned between the third metal sheet and the fourth radiating arm; two ends of the sixth radiating arm are perpendicularly connected to a junction of the first radiating arm and the seventh radiating arm, respectively; the seventh radiating arm is coplanar with the connecting arm; the seventh radiating arm substantially perpendicularly extends towards the connecting arm to be parallel to the third radiating arm; the fourth metal sheet is coplanar with the connecting arm; and the fourth metal sheet substantially perpendicularly extends from an edge of the seventh radiating arm adjacent to the first radiating arm to be parallel with the connecting arm.

16. The wireless communication device of claim 12, wherein the diversity antenna further comprises a connecting portion, a first radiating portion, and a second radiating portion; wherein the first radiating portion and the second radiating portion extend from the connecting portion; the connecting portion is positioned in a plane substantially perpendicular to the plane in which the feeding portion and the grounding portion are positioned; the connecting portion comprises a first connecting section, a second connecting section, and a third connecting section; the first connecting section is substantially perpendicularly connected to an end of the feeding portion; the second connecting section is substantially perpendicularly connected to an end of the grounding portion; and an end of the third connecting section is substantially perpendicularly connected to an end of the first connecting section away from the feeding portion, another end of the third connecting section is substantially perpendicularly connected to an end of the second connecting section away from the grounding portion.

17. The wireless communication device of claim 16, wherein the first radiating portion comprises a first radiating section, a second radiating section, a third radiating section, and a fourth radiating section; the first radiating section is coplanar with the connecting portion; the first radiating section continuously extends from first connecting section, then extends towards the second connecting section to be parallel to the third connecting section; the second radiating section is positioned in a plane substantially parallel to the plane in which the feeding portion and the grounding portion are positioned; the second radiating section is substantially perpendicularly connected to an end of the first radiating section away from the first connecting section; the third radiating section is substantially perpendicularly connected to an end of the second radiating section away from the first radiating section; the fourth radiating section is positioned in a plane substantially perpendicular to a plane in which the connecting portion is positioned; and the fourth radiating section is substantially perpendicularly connected to an end of the third radiating section away from the second radiating section.

18. The wireless communication device of claim 17, wherein the second radiating portion comprises a fifth radiating section and a sixth radiating section; the fifth radiating section is coplanar with the connecting portion; the fifth radiating section extends from a junction between the feeding portion and the first connecting section to be parallel to the third connecting section, then extends away the first radiating section to be parallel to the first connecting section, and extends away the second connecting section to be parallel to the third connecting section; the sixth radiating section is coplanar with the fourth radiating section; and the sixth radiating section is substantially perpendicularly connected to an end of the fifth radiating section away from first connecting section and is parallel to the fourth radiating section.

19. The wireless communication device of claim 12, wherein a connection between the first grounding section and the second grounding section is substantially perpendicular to the connection between the feeding portion and the grounding portion.

20. The wireless communication device of claim 19, wherein the second accessorial arm extends from an end of the first accessorial arm away from the second grounding section to be parallel to the connecting arm, then extends towards the diversity antenna to be parallel to the first connecting section, and extends towards the first accessorial arm to be parallel to the connecting arm.

* * * * *